US006168518B1

(12) United States Patent
Messmer et al.

(10) Patent No.: US 6,168,518 B1
(45) Date of Patent: Jan. 2, 2001

(54) VENT STRUCTURE WITH SLOTTED RECTANGULAR OUTLET

(75) Inventors: Craig S. Messmer; Joseph F. Intagliata, both of St. Louis, MO (US)

(73) Assignee: Unico, Inc., St. Louis, MO (US)

( * ) Notice: Under 35 U.S.C. 154(b), the term of this patent shall be extended for 0 days.

(21) Appl. No.: 09/287,244

(22) Filed: Apr. 7, 1999

(51) Int. Cl.[7] ..... F24F 7/00
(52) U.S. Cl. ..... 454/305; 454/284; 454/301
(58) Field of Search ..... 454/284, 289, 454/301, 305, 330

(56) References Cited

U.S. PATENT DOCUMENTS

| | | | |
|---|---|---|---|
| 2,845,855 | 8/1958 | Burns . | |
| 2,991,708 | 7/1961 | Falk et al. . | |
| 3,359,883 | 12/1967 | Murphy . | |
| 3,390,624 | 7/1968 | Averill . | |
| 3,401,622 | 9/1968 | Honerkamp . | |
| 3,673,946 | 7/1972 | Ragland . | |
| 3,757,668 | 9/1973 | Dean, Jr. . | |
| 4,103,598 | 8/1978 | Cooper . | |
| 4,136,606 * | 1/1979 | Wolbrink | 454/231 |
| 4,726,285 | 2/1988 | Kelley . | |
| 5,261,857 | 11/1993 | Peterson et al. . | |
| 5,338,254 | 8/1994 | Farrington . | |

* cited by examiner

*Primary Examiner*—Denise L. Ferensic
*Assistant Examiner*—Jiping Lu
(74) *Attorney, Agent, or Firm*—Shughart, Thomson & Kilroy, P.C.

(57) ABSTRACT

A vent structure with a slotted rectangular outlet includes a cylindrical connector section to mate with a cylindrical duct, a flared and curved transition section, and a rectangular outlet section. The structure is formed in such a manner that turbulence is minimized in air flowing through the structure to thereby lessen the generation of airflow noise. The structure is sized and shaped to fit within a stud wall formed by conventionally sized studs positioned at a typical spacing. The structure includes a mounting plate with a mounting channel to receive an extendible mounting bracket, the ends of which are fastened to studs between which the structure is mounted.

18 Claims, 2 Drawing Sheets

10
1
15
30
36
20
6
18
16
26
24
12
38
22
3
14
4
29
7
28
2
46
48
5

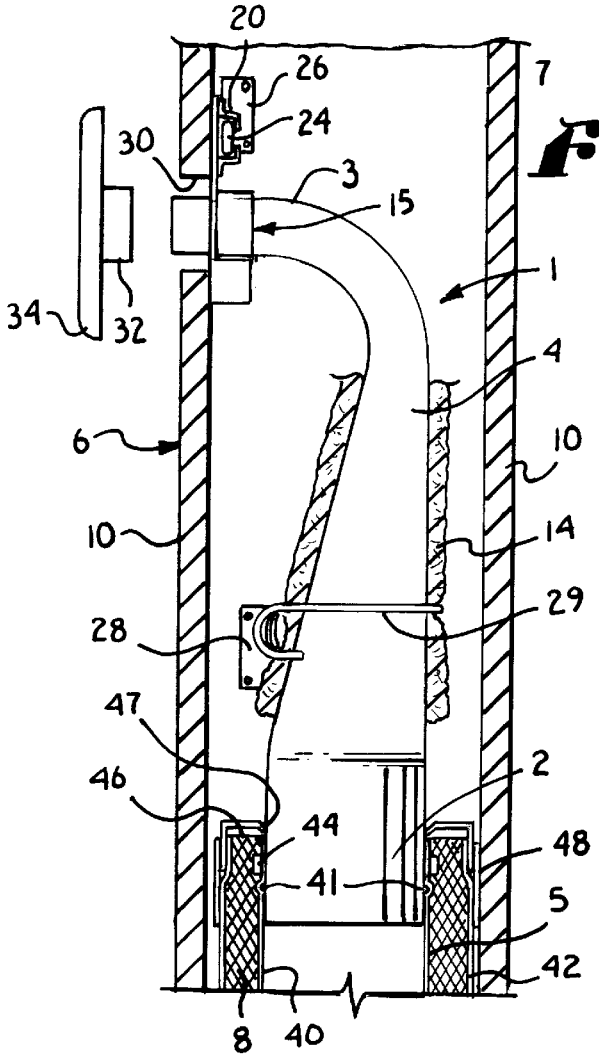
Fig. 2.
Fig. 3.
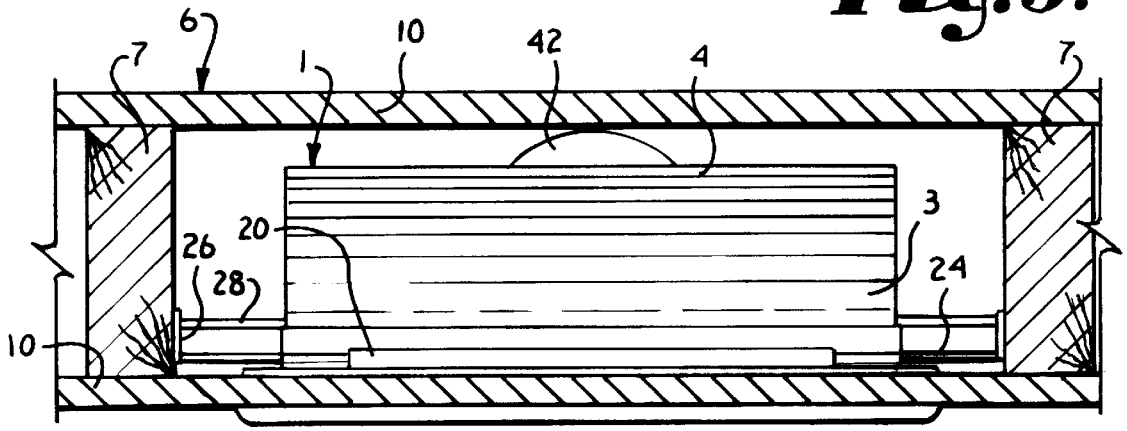

VENT STRUCTURE WITH SLOTTED RECTANGULAR OUTLET

BACKGROUND OF THE INVENTION

There are many types of vent structures for distributing air from heating, ventilation, and air conditioning (HVAC) ducts into rooms. In general, a vent structure must connect with the air duct with minimal leakage and change the airflow direction to a particular direction to achieve the desired environmental effect. It is also desirable for a vent structure to fit within a wall structure of a common configuration. A common problem with conventional vent structures is the generation of audible noise by air flowing through the direction changing structure and vent louvers. Airflow noise is generally caused by turbulence resulting from a change of direction or a restriction that is too abrupt. Airflow noise can also result from structural components that are vibrated by the flow of air thereover, by natural resonances within the vent structure, and the like.

In conventional home construction, HVAC ducts are formed of sheet metal and have rectangular cross sections. The ducts and outlet registers have cross sectional areas in the range of tens of square inches. Within conventional stud wall sections, the ducts often occupy most of the space between a pair of adjacent studs. Conventional home environmental systems move heated or cooled air at relatively low velocities.

In some newer ducting designs, cylindrical ducts are used which have much smaller cross sectional areas than more conventional ducts, in the range of less than ten square inches. Airflow through such smaller ducts is at a higher velocity than in conventional ducts to achieve comparable volumetric flow rates and to promote better mixing of conditioned air into the ambient air within a room. The smaller ducts generally have a lower manufacturing cost because less material is used and because manufacturing labor is reduced. Additional advantages include more convenient installation and higher energy efficiency, since there is less surface area through which heat can be transferred. However, because of higher flow velocities, the potential for generating undesirable noise is increased. What is needed, is a type of vent structure to distribute conditioned air from such high velocity ducts without generating noise or decreasing the airflow efficiency of the ducts.

SUMMARY OF THE INVENTION

The present invention provides a vent structure which connects between a cylindrical airflow duct to a thin rectangular outlet slot by way of a curved, angularly flared transition section. A cylindrical connector section provides for connection to a cylindrical duct. A horizontal airflow axis of a rectangular outlet section is oriented perpendicular to a usually vertical duct axis. The flare section diverges angularly from the connector section to the outlet section and curves to change the direction of airflow from vertical to horizontal. The cross sectional areas of the flare section and outlet section, in combination with the gradual curved shape of the flare section, minimize the introduction of turbulence in air flowing therethrough and, thereby, minimize the generation of airflow noise. Additionally, the vent structure of the present invention is sized and shaped to fit within a section of a stud wall having standard stud width and spacing.

A mounting plate is positioned in surrounding relation to the outlet section and has walls forming a mounting channel on a rear side thereof. An extendible mounting bracket or hanger bar is positioned within the mounting channel and has fastener plates at opposite ends to receive fasteners, such as nails, for attachment to the studs between which the vent structure is mounted. An additional extendible bracket may be extended beneath the outlet section at a middle portion of the flare section to which it is secured to provide additional support for the vent structure. An external trim plate with a slot is positioned about the outlet section on the wallboard behind which the vent structure is mounted. The trim plate has a neck section which is slidably received onto the outer end of the outlet section to facilitate use of the present invention with wall sections employing wall boards of a range of thicknesses. The flare section, and at least a portion of the outlet section, preferably has a layer of foam insulation thereon to inhibit the collection of condensation on the outer surfaces of the flare section when cooled air flows through the system.

OBJECTS AND ADVANTAGES OF THE INVENTION

The principal objects of the present invention are: to provide an improved outlet vent structure; to provide such a structure for a relatively high airflow velocity heating and cooling duct of a cylindrical cross section; to provide such a structure including a thin rectangular or slot outlet; to provide such a structure which changes the direction of airflow and transitions from the circular cross section of the duct to the rectangular shape of the outlet with a minimum of turbulence and airflow noise; to provide such a vent structure including a cylindrical connector section to mate with the cylindrical duct, a rectangular outlet section having a thin rectangular outlet slot, and a curved, angularly flared transition section in flow communication between the connector section and the outlet section; to provide such a vent structure which is sized and shaped to fit within a section of a conventional stud wall formed by studs having a standard width and positioned at a standard spacing; to provide such a vent structure including a mounting plate having a mounting channel to receive an extendible mounting bracket with attachment plates at opposite ends for connection to the studs forming the wall section in which the vent structure is mounted; to provide such a vent structure including an outer layer of thermal insulation to inhibit the precipitation of condensation on outer surfaces of the structure when cooled air flows therethrough; and to provide such a vent structure which is economical to manufacture, which is efficient in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a side elevational view of the vent structure positioned within a stud wall, with a trim plate shown separated from the rectangular outlet slot.

FIG. 3 is a top plan view of the vent structure of the present invention within a section of a stud wall.

DETAILED DESCRIPTION OF THE INVENTION

Figure 1:
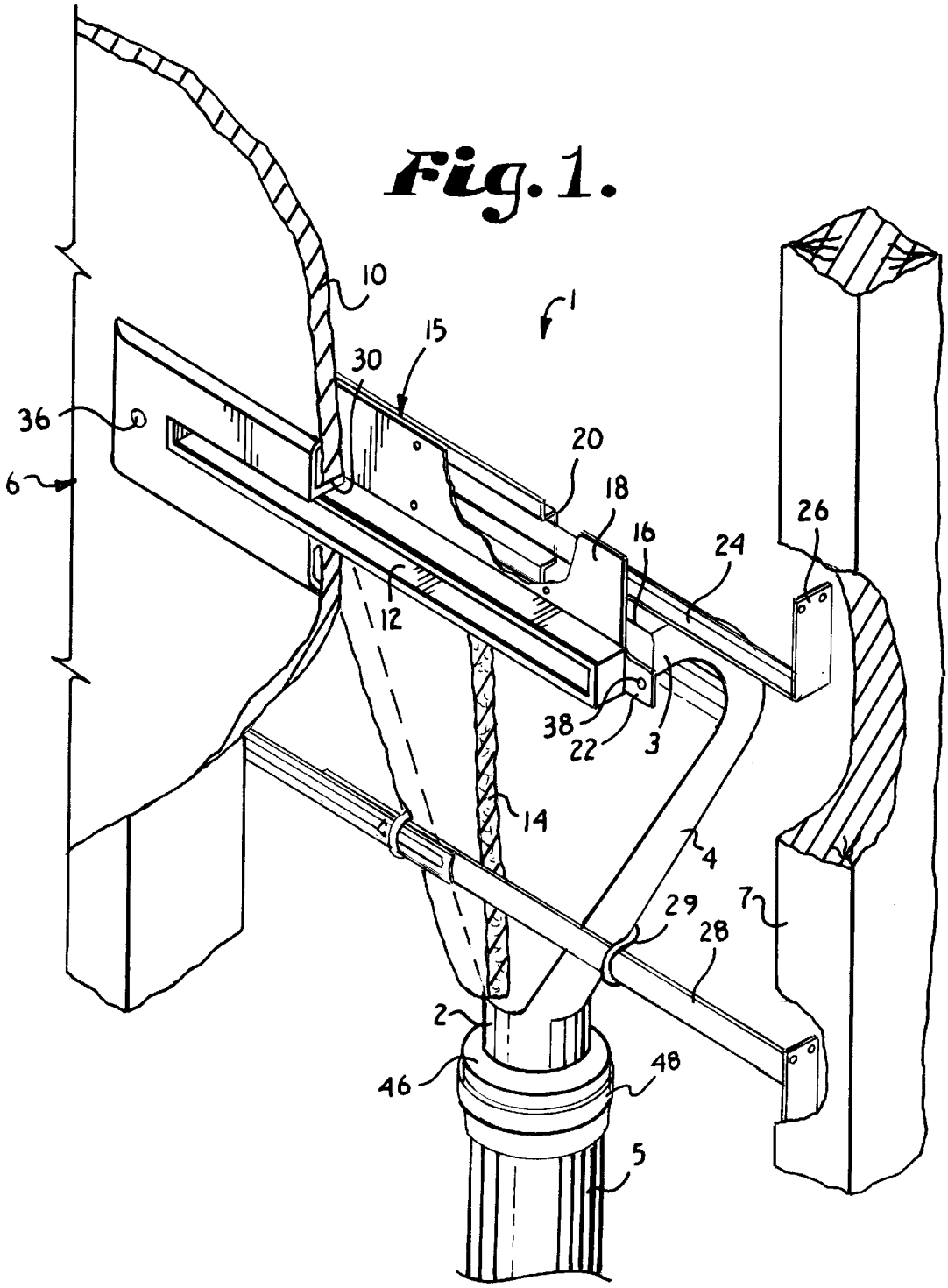
FIG. 1 is a fragmentary perspective view of the vent structure which embodies the present invention, with portions broken away to show details of the structure.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a vent structure with a slotted rectangular outlet which embodies the present invention. The vent structure 1 generally includes a cylindrical connector section 2, a rectangular outlet section 3, and a curving, flared transition section 4. The structure 1 is intended to function as an outlet vent for a heating/air conditioning system (not shown) which employs cylindrical ducting 5 and which generates airflow having a relatively high velocity. Additionally, the structure 1 is designed to fit within a stud wall structure 6 formed by studs 7 having a conventional width and positioned at conventional spacings.

The stud wall structure 6 includes the vertically oriented studs 7 which are regularly spaced in typical construction, depending on the load to be supported thereby. In conventional home construction, the studs 7 are spaced so that their center longitudinal planes are at sixteen inch spacings, that is, the studs 7 are positioned "at sixteen inch centers". The studs 7 are preferably of a standard size, such as studs having nominal thickness and width dimensions of two inches by four inches, commonly referred to as two-by-fours. The studs 7 extend between a sole plate at the bottom and a top plate (neither shown) to form a wall framework. The stud wall 6 includes wallboards 10 (FIGS. 2 and 3) nailed, or otherwise attached, to the studs 7 and may be indoor types of wallboard, such as gypsum based types, or outdoor types of wallboard, such as those incorporating thermal insulation.

The illustrated ducting assembly or duct 5 has a cylindrical cross section and has a nominal two inch inner diameter. Because the cross sectional area of the duct 5 is considerably less than conventional ducting, airflow through the ducts 5 occurs at a higher velocity to achieve comparable volumetric capacity. In order to service the heating, cooling, and ventilating needs of a room of a given area, a greater number of ducts 5 may be required, as compared to conventional ducting. A principal advantage of the higher velocity airflow is the promotion of more efficient mixing of conditioned air from the ducts 5 with ambient air in a room. The duct 5 is preferably covered with a layer of a thermal insulation 8 to retard undesired heat flow through the walls of the ducts.

Referring to FIGS. 1 and 2, the connector section 2 is sized to fit within an end of a cylindrical duct 5. The transition or flare section 4 diverges angularly from the connector section 2 toward the outlet section 3. The flare section 4 curves smoothly as it merges with the outlet section 3, to avoid abrupt changes of direction in the airflow through the structure 1. The outlet section 3 has a rectangular cross section and terminates in an outlet slot 12.

The cross sectional areas of the connector section 2, the flare section 4, and the outlet section 3 are equal to or greater than the internal cross sectional area of the duct 5, to avoid restrictions to the airflow through the structure 1. By smoothing the change of direction of airflow through the structure 1 and avoiding constrictions, the creation of turbulence within the structure 1, and noise generated thereby, is minimized.

The vent structure 1 is preferably formed of cast aluminum. However, the structure 1 could alternatively be formed of a plastic, a glass reinforced resin, or the like. The vent structure 1, formed of aluminum, is preferably covered with a layer of insulation material 14, such as a foam rubber, to retard the collection of condensation on the surfaces of the structure 1, as when cooled air flows therethrough.

A mounting assembly 15 for the vent structure 1 includes a mounting collar 16 having an upstanding mounting plate 18. On a rear surface of the mounting plate 18, a mounting channel 20 is formed by opposing walls which have a Z-shape. A pair of trim plate fastener tabs 22 extend from opposite ends of the mounting collar 16. The mounting collar 16 is clamped about the outlet section 3 of the structure 1. The illustrated mounting assembly 15 is formed of sheet metal.

An elongated, extendible mounting bracket member or hanger bar 24 extends through the mounting channel 20 and has fastener tabs 26 positioned perpendicularly at its opposite ends. The bracket member 24 is extended so that the tabs 26 engage the studs 7, between which the structure 1 is installed. Fasteners such as nails or screws (not shown) are used to attach the tabs 26 to the studs 7. Although the bracket member 24 usually provides adequate support for the structure 1, a second extendible bracket member 28, substantially similar to the bracket 24, is preferably extended between the studs 7 at a middle section of the flare section 4 to provide additional support for the structure 1. The ends of the bracket member 28 are also fastened to the studs 7. The bracket member 28 may be secured to the flare section 4 as by a length of wire 29, a ratcheted cable bundle tie, or the like.

The outlet section 3 exits the stud wall structure 6 through a wallboard slot 30 cut in an appropriate one of the wallboards 10. The slot 30 is sized slightly larger than the dimensions of the outlet section 3 to receive a neck 32 of a trim plate 34 which provides a finished appearance to the installation. The neck 32 telescopes onto the outlet section 3 and allows flush mounting of the structure 1 with wallboards 10 having a thickness range of about 0.375 to 0.75 inch. The plate 34 has fastener apertures 36 which align with fastener apertures 38 formed in the tabs 22 of the mounting assembly 15. Fasteners such as screws (not shown) are used to fix the trim plate 34 in place.

The duct 5 and the vent structure 1 are most conveniently installed in the stud wall structure 6 prior to fastening the wallboard 10 on the studs 7. Because of the relatively high velocity of air exiting the outlet slot 12, it is preferable that the structure 1 is positioned at a relatively high position. Once the duct 5 has been installed and cut to the required heights the vent structure can be installed. The duct assembly 5 includes an inner cylindrical duct wall 40 and a coaxially positioned cylindrical vapor barrier 42, with the thermal insulation 8 positioned therebetween. The connector section 2 preferably has means such as one or more lugs 41 (FIG. 2) formed thereon. The connector section is secured to the duct wall 40 by means such as a hose clamp 44 which is positioned above the lugs 41 whereby cooperation of the lugs 41 with the clamp 44 provides a non-slip joint between the duct wall 40 and the connector section 2. A tape ring collar 46 is placed on the connector section 2 prior to insertion into the duct wall 40 to cover the joint between the end of the duct 5 and the connector section 2 to prevent crushing the insulation 8 within the duct assembly 5. The tape ring 46 has an aperture 47 which has a slightly smaller diameter than the connector section 2 to provide a tight, sealing fit between it and the connector section 2. The tape ring 46 is secured to the vapor barrier 42 by means such as an adhesively backed aluminum foil tape 48 which extends around the joint therebetween.

After the vent structure 1 has been fixed in place, the wallboard slot 30 can be located and cut into the wallboard 10, prior to fastening the wallboard 10 to the studs 7. Finally, the trim plate 7 is fixed in place.

Although the vent structure 1 of the present invention has been shown in connection with a vertically oriented duct 5, such that the outlet slot 12 extends in a horizontal direction, the vent structure 1 could alternatively be constructed in such a manner that the outlet slot 12 is parallel to the axis of the duct 5. Such a modification might be appropriate where a horizontally extending duct 5 is used and it is desired to orient the outlet slot 12 horizontally. Also, while the vent structure 1 has been described and illustrated as being installed in a section of a vertical wall structure 6, it is contemplated that the structure 1 could also find application in an angled wall, a ceiling structure, or a floor arrangement.

It is to be understood that while certain forms of the present invention have been illustrated and described herein, it is not to be limited to the specific forms or arrangement of parts described and shown.

What is claimed and desired to be secured by letters patent is as follows:

1. An air handling vent structure for use with a circular cross section duct having a duct longitudinal axis, said structure comprising:

(a) a substantially cylindrical connector section having a size and shape to mate with said circular duct;

(b) a rectangular outlet section positioned to direct air into a room in a direction substantially perpendicular to said duct axis;

(c) a flare section extending and providing communication between said connector section and said outlet section;

(d) said flare section and said outlet section having such internal cross sectional areas and said flare section having such a shape that air flowing therethrough is subjected to minimal turbulence in transitioning from flow through said duct to flow through said outlet section; and (e) said flare section curving and diverging in dimension from said connector section to said outlet section, said flare section having a circular inlet end connected to said connector section and smoothly transitioning to a rectangular outlet end.

2. An air handling vent structure for use with a circular cross section duct having a duct longitudinal axis, said structure comprising:

(a) a substantially cylindrical connector section having a size and shape to mate with said circular duct;

(b) a rectangular outlet section positioned to direct air into a room in a direction substantially perpendicular to said duct axis;

(c) a flare section extending and providing communication between said connector section and said outlet section;

(d) said flare section and said outlet section having such internal cross sectional areas and said flare section having such a shape that air flowing therethrough is subjected to minimal turbulence as compared to airflow through said duct;

(e) said flare section curving and diverging in dimension from said connector section to said outlet section, said flare section having a circular inlet end connected to said connector section and smoothly transitioning to a rectangular outlet end; and said connector section and said flare section are sized and shaped to fit within a stud wall structure between a pair of wall studs and having substantially typical dimensions of wall thickness and spacing between said studs.

3. An air handling vent structure for use with a circular cross section duct having a duct longitudinal axis, said structure comprising:

(a) a substantially cylindrical connector section having a size and shape to mate with said circular duct;

(b) a rectangular outlet section positioned to direct air into a room in a direction substantially perpendicular to said duct axis;

(c) a mounting collar positioned in surrounding relation to said outlet section;

(d) said mounting collar including channel walls forming an elongated mounting channel positioned and sized to receive an elongated mounting bracket;

(e) a flare section extending and providing communication between said connector section and said outlet section; and (f) said flare section and said outlet section having such internal cross sectional areas and said flare section having such a shape that air flowing therethrough is subjected to minimal turbulence in transitioning from flow through said duct to flow through said outlet section.

4. A structure as set forth in claim 3 wherein:

(a) said connector section and said flare section are sized and shaped to fit within a stud wall structure between a pair of wall studs and having substantially typical dimensions of wall thickness and spacing between said studs.

5. A structure as set forth in claim 3 wherein:

(a) said flare section curves and diverges in dimension from said connector section to said outlet section.

6. A structure as set forth in claim 3 and including:

(a) an extendible mounting bracket sized and shaped to be received within said mounting channel and adapted for connection to a support member to thereby support said vent structure.

7. A structure as set forth in claim 3 and including:

(a) an external trim plate positioned in surrounding relation to an outer end of said outlet section.

8. A structure as set forth in claim 3 and including:

(a) said outlet section forms an outlet slot having a substantially long length relative to a substantially narrow height.

9. An air handling vent structure for use with a circular cross section duct having a duct longitudinal axis, said structure comprising:

(a) a substantially cylindrical connector section having a size and shape to mate with said circular duct;

(b) a rectangular outlet section positioned to direct air into a room in a direction substantially perpendicular to said duct axis;

(c) a mounting collar positioned in surrounding relation to said outlet section, (d) said mounting collar including channel walls forming an elongated mounting channel positioned and sized to receive an elongated mounting bracket;

(e) a flare section extending and providing communication between said connector section and said outlet section;

(f) said flare section and said outlet section having such internal cross sectional areas and said flare section having such a shape that air flowing therethrough is subjected to minimal turbulence as compared to airflow through said duct; and (g) said connector section and said flare section are sized and shaped to fit within a stud wall structure between a pair of wall studs and having substantially typical dimensions of wall thickness and spacing between said studs.

10. A structure as set forth in claim 9 wherein:

(a) said flare section curves and diverges in dimension from said connector section to said outlet section.

11. A structure as set forth in claim 9 and including:

(a) an extendible mounting bracket sized and shaped to be received within said mounting channel and adapted for connection to a support member to thereby support said vent structure.

12. A structure as set forth in claim 9 and including:

(a) said outlet section forms an outlet slot having a substantially long length relative to a substantially narrow width.

13. A structure as set forth in claim 9 and including:

(a) an external trim plate positioned in surrounding relation to an outer end of said outlet section.

14. A structure as set forth in claim 9 and including:

(a) said outlet section forms an outlet slot having a substantially long length relative to a substantially narrow height.

15. An air handling vent structure for use with a circular cross section duct having a duct longitudinal axis, said structure comprising:

(a) a substantially cylindrical connector section having a size and shape to mate with said circular duct;

(b) a rectangular outlet section positioned to direct air into a room in a direction substantially perpendicular to said duct axis;

(c) a flare section extending and providing communication between said connector section and said outlet section;

(d) said flare section and said outlet section having such internal cross sectional areas and said flare section having such a shape that air flowing therethrough is subjected to minimal turbulence as compared to airflow through said duct;

(e) said connector section and said flare section being sized and shaped to fit within a stud wall structure between a pair of wall studs and having substantially typical dimensions of wall thickness and spacing between said studs;

(f) said flare section curving and diverging in dimension from said connector section to said outlet section;

(g) a mounting collar positioned in surrounding relation to said outlet section; and (h) said mounting collar including channel walls forming an elongated mounting channel positioned and sized to receive an elongated mounting bracket.

16. A structure as set forth in claim 15 and including:

(a) an external trim plate positioned in surrounding relation to an outer end of said outlet section.

17. A structure as set forth in claim 15 and including:

(a) said outlet section forms an outlet slot having a substantially long length relative to a substantially narrow height.

18. A structure as set forth in claim 15 and including:

(a) an extendible mounting bracket sized and shaped to be received within said mounting channel and adapted for connection to one of said studs to thereby support said vent structure.

* * * * *